US008385573B2

(12) United States Patent
Higgins

(10) Patent No.: US 8,385,573 B2
(45) Date of Patent: Feb. 26, 2013

(54) SYSTEM FOR HEARING ASSISTANCE DEVICE INCLUDING RECEIVER IN THE CANAL

(75) Inventor: Sidney A. Higgins, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1254 days.

(21) Appl. No.: 11/857,439

(22) Filed: Sep. 19, 2007

(65) Prior Publication Data

US 2009/0074218 A1 Mar. 19, 2009

(51) Int. Cl.
*H04R 25/00* (2006.01)

(52) U.S. Cl. ..... 381/322; 381/323; 381/328; 381/384

(58) Field of Classification Search ..... 381/322
See application file for complete search history.

(56) References Cited

U.S. PATENT DOCUMENTS

| | | | | |
|---|---|---|---|---|
| 3,728,509 | A | 4/1973 | Shimojo | |
| 3,812,300 | A | 5/1974 | Brander et al. | |
| 4,017,834 | A * | 4/1977 | Cuttill et al. | 283/83 |
| 4,310,213 | A * | 1/1982 | Fetterolf et al. | 439/320 |
| 4,571,464 | A | 2/1986 | Segero | |
| 4,729,166 | A | 3/1988 | Lee et al. | |
| 5,606,621 | A | 2/1997 | Reiter et al. | |
| 5,687,242 | A | 11/1997 | Iburg | |
| 5,755,743 | A | 5/1998 | Volz et al. | |
| 5,824,968 | A | 10/1998 | Packard et al. | |
| 5,987,146 | A | 11/1999 | Pluvinage et al. | |
| 6,766,030 | B1 * | 7/2004 | Chojar | 381/322 |
| 6,876,074 | B2 | 4/2005 | Kim | |
| 7,016,512 | B1 | 3/2006 | Feeley et al. | |
| 7,110,562 | B1 | 9/2006 | Feeley et al. | |
| 7,139,404 | B2 * | 11/2006 | Feeley et al. | 381/330 |
| 7,142,682 | B2 | 11/2006 | Mullenborn et al. | |
| 7,256,747 | B2 | 8/2007 | Victorian et al. | |
| 7,446,720 | B2 | 11/2008 | Victorian et al. | |
| 7,471,182 | B2 | 12/2008 | Kumano et al. | |
| 7,593,538 | B2 | 9/2009 | Polinske | |
| 8,098,863 | B2 | 1/2012 | Ho et al. | |
| 8,116,495 | B2 | 2/2012 | Spaulding | |
| 2003/0178247 | A1 | 9/2003 | Saltykov | |
| 2003/0200820 | A1 | 10/2003 | Takada et al. | |
| 2004/0114776 | A1 | 6/2004 | Crawford et al. | |

(Continued)

FOREIGN PATENT DOCUMENTS

| | | | |
|---|---|---|---|
| DE | 3006235 | A1 | 10/1980 |
| DE | 3643124 | A1 | 7/1988 |

(Continued)

OTHER PUBLICATIONS

"European Application No. 08253065.0, Extended Search Report Mailed Dec. 15, 2008", 9 pgs.

(Continued)

*Primary Examiner* — Christopher Uhlir
(74) *Attorney, Agent, or Firm* — Schwegman, Lundberg & Woessner, P.A.

(57) ABSTRACT

The present subject matter includes a hearing assistance device connection system for a user having an ear canal comprising a housing, electronics disposed in the housing, a cable electrically connected to the receiver and at least one conductive silicone component to electrically connect the electronics to the receiver.

25 Claims, 7 Drawing Sheets

U.S. PATENT DOCUMENTS

| | | | |
|---|---|---|---|
| 2004/0240693 | A1 | 12/2004 | Rosenthal |
| 2005/0008178 | A1 | 1/2005 | Joergensen et al. |
| 2006/0097376 | A1 | 5/2006 | Leurs et al. |
| 2007/0036374 | A1 | 2/2007 | Bauman et al. |
| 2007/0121979 | A1 | 5/2007 | Zhu et al. |
| 2007/0188289 | A1 | 8/2007 | Kumano et al. |
| 2008/0003736 | A1 | 1/2008 | Arai et al. |
| 2008/0026220 | A9 | 1/2008 | Bi et al. |
| 2008/0187157 | A1 | 8/2008 | Higgins |
| 2008/0199971 | A1 | 8/2008 | Tondra |
| 2009/0075083 | A1 | 3/2009 | Bi et al. |
| 2009/0196444 | A1 | 8/2009 | Solum |
| 2009/0245558 | A1 | 10/2009 | Spaulding |
| 2009/0262964 | A1 | 10/2009 | Havenith et al. |
| 2010/0034410 | A1 | 2/2010 | Link et al. |
| 2010/0074461 | A1 | 3/2010 | Polinske |
| 2010/0124346 | A1 | 5/2010 | Higgins |
| 2010/0158291 | A1 | 6/2010 | Polinske et al. |
| 2010/0158293 | A1 | 6/2010 | Polinske et al. |
| 2010/0158295 | A1 | 6/2010 | Polinske et al. |
| 2012/0014549 | A1 | 1/2012 | Higgins et al. |

FOREIGN PATENT DOCUMENTS

| | | | |
|---|---|---|---|
| DE | 4005476 | A1 | 7/1991 |
| DE | 9320391 | | 9/1993 |
| DE | 4233813 | C1 | 11/1993 |
| DE | 29801567 | U1 | 5/1998 |
| EP | 0339877 | A3 | 11/1989 |
| EP | 0866637 | A2 | 9/1998 |
| EP | 1065863 | A2 | 1/2001 |
| EP | 1465457 | A2 | 10/2004 |
| EP | 1496530 | A2 | 1/2005 |
| EP | 1811808 | A1 | 7/2007 |
| EP | 1816893 | A1 | 8/2007 |
| EP | 2040343 | A1 | 3/2009 |
| EP | 2107829 | B1 | 5/2012 |
| GB | 1298089 | | 11/1972 |
| GB | 1522549 | | 8/1978 |
| JP | 2209967 | A | 8/1990 |
| JP | 2288116 | A | 11/1990 |
| JP | 09199662 | | 7/1997 |
| WO | WO-2004025990 | A1 | 3/2004 |
| WO | WO-2006094502 | A1 | 9/2006 |
| WO | WO-2007148154 | A1 | 12/2007 |
| WO | WO-2008092265 | A1 | 8/2008 |
| WO | WO-2008097600 | A1 | 8/2008 |
| WO | WO-2008097600 | C1 | 8/2008 |

OTHER PUBLICATIONS

"European Application Serial No. 08253065.0, Office Action mailed Jul. 17, 2009", 1 pg.
"European Application Serial No. 09250729.2, Extended Search Report Mailed Dec. 14, 2009", 4 pgs.
"European Application Serial No. 08253065.0, Response filed Jan. 26, 2010 to Office Action mailed Jul. 17, 2009", 9 pgs.
"European Application Serial No. 08253065.0, Response to Office Action filed Feb. 28, 2011 to European Office Action mailed Aug. 26, 2010", 17 pgs.
"European Application Serial No. 08725262.3, Office Action mailed Apr. 21, 2010", 6 Pgs.
"European Application Serial No. 08725262.3, Office Action Response Filed Nov. 2, 2010", 14 pgs.
"European Application Serial No. 09168844.0, Office Action Response Filed: Nov. 15, 2010", 8 pgs.
"International Application Serial No. PCT/US2008/001609, International Preliminary Report on Patentability mailed Aug. 20, 2009", 10 pgs.
"International Application Serial No. PCT/US2008/001609, Search Report mailed Jun. 19, 2008", 7 pgs.
"International Application Serial No. PCT/US2008/001609, Written Opinion mailed Jun. 19, 2008", 8 pgs.
Buchoff, L S, "Advanced Non-Soldering Interconnection", Electro International, 1991 (IEEE), XP 10305250A1, (1991), 248-251.
"European Application Serial No. 08253065.0, European Office Action mailed Aug. 26, 2010", 6 Pgs.
"European Application Serial No. 09168844.0, European Search Report mailed Apr. 19, 2010", 3 Pgs.
"European Application Serial No. 09168844.0, Office Action mailed May 3, 2010", 5 pgs.
Tondra, Mark, "U.S. Appl. No. 60/887,609, filed Feb. 1, 2007", 28 pgs.
"U.S. Appl. No. 12/027,173, Final Office Action mailed Dec. 8, 2011", 12 pgs.
"U.S. Appl. No. 12/027,173, Non Final Office Action mailed Jul. 11, 2011", 10 pgs.
"U.S. Appl. No. 12/027,173, Response filed Nov. 14, 2011 to Non Final Office Action mailed Jul. 11, 2011", 8 pgs.
"U.S. Appl. No. 12/059,578, Notice of Allowance mailed Oct. 5, 2011", 8 pgs.
"U.S. Appl. No. 12/548,051, Non Final Office Action mailed Oct. 12, 2011", 11 pgs.
"European Application Serial No. 08253065.0, European Examination Notification mailed Oct. 11, 2011", 7 pgs.
"European Application Serial No. 08725262.3, Office Action mailed Aug. 5, 2011", 5 pgs.
"European Application Serial No. 09168844.0, Office Action mailed Apr. 28, 2011", 5 pgs.
"U.S. Appl. No. 12/548,051, Response filed Jan. 12, 2012 to Non Final Office Action mailed Oct. 12, 2011", 9 pgs.
"European Application Serial No. 08253065.0, Response filed Feb. 8, 2012 to Examination Notification mailed Oct. 11, 2011", 15 pgs.
"European Application Serial No. 08725262.3, Response filed Feb. 13, 2012 to Office Action mailed Aug. 5, 2011", 11 pgs.
"U.S. Appl. No. 12/027,173, Non Final Office Action mailed Jul. 27, 2012", 11 pgs.
"U.S. Appl. No. 12/027,173, Response filed Jun. 8, 2012 to Final Office Action mailed Dec. 8, 2011", 7 pgs.
"U.S. Appl. No. 12/539,195, Non Final Office Action mailed Jul. 20, 2012", 13 pgs.
"U.S. Appl. No. 12/548,051, Final Office Action mailed Apr. 19, 2012", 12 pgs.
"European Application Serial No. 08725262.3, Summons to Attend Oral Proceedings mailed Jun. 6, 2012", 5 pgs.
"European Application Serial No. 09168844.0, Office Action mailed May 14, 2012", 2 pgs.
"European Application Serial No. 09168844.0, Response filed Feb. 24, 2012 to Office Action mailed Apr. 28, 2011", 12 pgs.
"European Application Serial No. 09168844.0, Response filed Jul. 24, 2012 to Examination Notification Art. 94(3) mailed May 14, 2012", 10 pgs.

* cited by examiner

SYSTEM FOR HEARING ASSISTANCE DEVICE INCLUDING RECEIVER IN THE CANAL

TECHNICAL FIELD

This application relates to hearing assistance devices and more particularly to electrical connections for hearing assistance devices.

BACKGROUND

Hearing assistance devices often require connection of separate components, thus exposing connectors to the environment outside a component housing. The exposed connectors, and associated cable, are susceptible to forces which can disrupt the connection. Additionally, most hearing assistance device users desire that any exposed component of a hearing assistance device be of minimal distraction to the user's appearance. Therefore, there exists in the art a need for improved connectors for hearing assistance device systems that provide reliable connections between system components and minimal visual distraction.

SUMMARY

This application addresses the foregoing needs in the art and other needs not discussed herein. Embodiments of system are provided for connection of a receiver placed in the ear of a user to electronics for a hearing assistance device. Some hearing assistance device application configurations include, but are not limited to, behind-the-ear housings including housings worn over the ear and on the ear.

In various embodiments, a system includes a cable providing a connection between the receiver and the electronics in a hearing assistance device housing. Such designs are intended to be unobtrusive and versatile so as to accommodate wear by the user. In various embodiments, the system allows for locking mechanisms to assure the mechanical and electrical integrity of the mated components of the system. Embodiments include a component of conductive silicone to facilitate the electrical connection interface and provide an environmental seal of the connection. The present subject matter provides various embodiments of different innovative connectors that have advantages over current connections and yield a more reliable and robust connection for hearing assistance device applications.

This Summary is an overview of some of the teachings of the present application and is not intended to be an exclusive or exhaustive treatment of the present subject matter. Further details about the present subject matter are found in the detailed description and the appended claims. The scope of the present invention is defined by the appended claims and their equivalents.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

Figure 1:
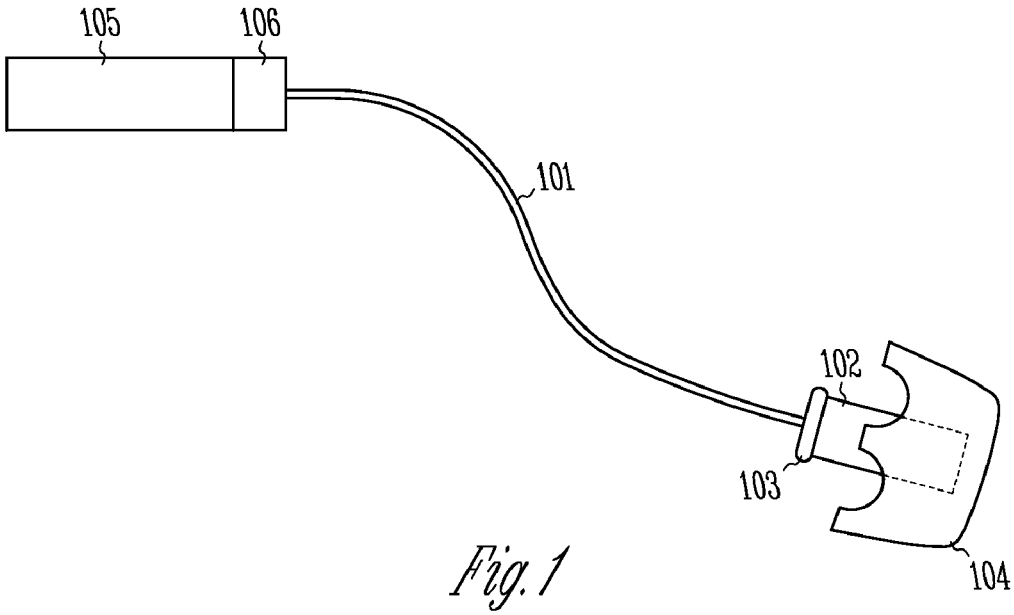
FIG. 1 illustrates a hearing assistance system according to one embodiment of the present subject matter.

FIG. 1 shows a basic hearing assistance system according to one example of the present subject matter. In the illustrated system, cable 101 forms an electrical connection to receiver 102 using a first connector 103. In the illustrated example, receiver 102 is mechanically connected to earbud 104. In various embodiments, the earbud 104 includes other apparatus, such as a locking member with a flexible filament, for imparting a force on the anatomy of the ear of a user to provide fixation of the receiver to the ear. The cable 101 also connects to hearing assistance electronics 105 using a second connector 106. Variations of this basic system may occur without departing from the scope of the present subject matter. For example, in various embodiments, a detachable connector 106 is provided for the connection to the hearing assistance electronics 105 and a soldered and molded connection 103 is provided at the receiver 102. Various embodiments include a cable with a shield and proper grounding to limit electromagnetic interference (EMI). These components are provided to show a basic system and provide examples to demonstrate various connections and system operation of the hearing assistance device.

A number of different connections may be used with the present system. In various embodiments, a pin and socket approach is used to provide the first connector 103. In various embodiments, a pin and socket approach is used to provide the second connector 106. In further embodiments, a pin and socket approach is used for both the first and second connector. In various embodiments, connections are made by soldering wires 101 to respective connection points on the receiver 102 and the electronics 105. In various embodiments, connections are made using a conductive silicone as an interface in the connections. Various forms of connections may be employed without departing from the scope of the present subject matter, and the connections provided herein are not intended in an exclusive or exhaustive sense.

Figure 2A:
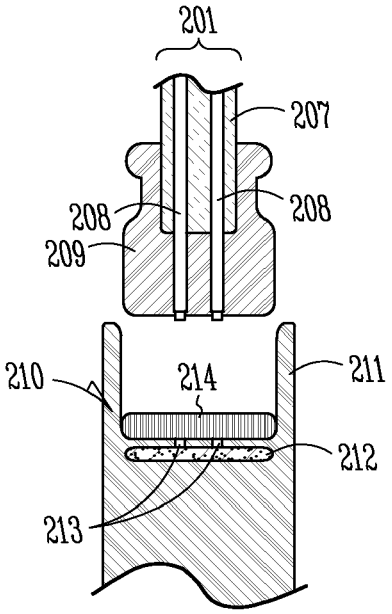
FIGS. 2A and 2B illustrate a connector according to one embodiment of the present subject matter.
Figure 2B:
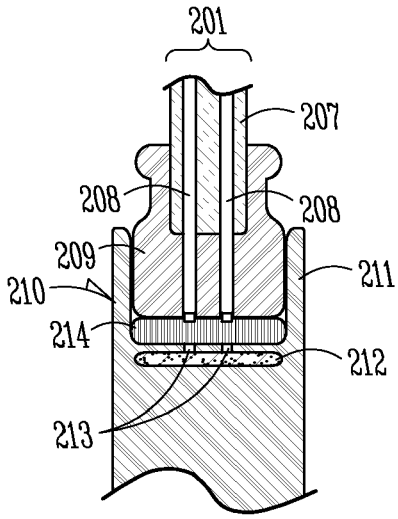

Through experimentation the inventors of the present subject matter have determined that conductive silicone has properties which provide benefits beyond that of conventional connections. FIGS. 2A and 2B illustrate a component of conductive silicone 214 disposed in a connector to provide a reliable electrical connection according to one embodiment of the present subject matter. FIG. 2A illustrates a plug and receptacle type connector. FIG. 2A includes a cable 201, illustrated as a two conductor insulated cable. Insulation 207 isolates the conductors 208 from each other as well as the environment external to the cable. The end of the cable is enclosed in a molded plug 209. The conductors 208 are exposed at the end of the plug 209. The exposed portions of the conductors provide the contact point for the plug of the illustrated connector system. In various embodiments, specialized connectors are attached to the ends of the conductors to provide a larger interface area of contact with the conductive silicone component 214. In various embodiments, the conductors of the receptacle are not limited to exposed traces of a circuit board, but may be, for example, exposed wires of a cable in contact with the conductive silicone component 214.

The receptacle 210 of the illustrated connector system includes insulation material 211, a flexible circuit board 212 with exposed traces 213 and an interface including a conductive silicone component 214. In the illustrated embodiment, insulating material 211 forms the body of the receptacle 210. In various embodiments, the insulation materials used to form the receptacle include mechanical features to engage and retain the insulation materials used to form the plug 209. In the illustrated embodiment, circuit board traces 213 are exposed in the well of the receptacle. The exposed traces 213 of the circuit board 212, integrated into the receptacle 210, are covered by a conductive silicone component 214 disposed in the receptacle 210.

FIG. 2B illustrates the connector embodiment of FIG. 2A engaged to form a connection between the conductors of the plug 208 and conductors of the receptacle 213. In some embodiments, the insulation material of the plug 209 and receptacle 211 include at least one locking mechanism. A locking mechanism includes one or more locking members. In one embodiment of the present subject matter, the locking members align the plug and receptacle to position the conductors correctly in applications where the polarity or the position of plug conductors with respect to receptacle conductors is necessary for proper operation. The locking members allow the plug and receptacle to engage when the respective conductors are correctly aligned.

Figure 2C:
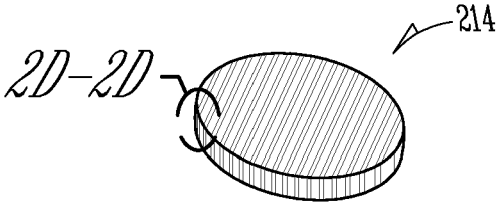
FIGS. 2C and 2D illustrate a layer of conductive silicone according to one embodiment of the present subject matter.

FIG. 2B illustrates one embodiment of a plug and receptacle 210 when fully engaged. The conductors 208 and exposed traces 213 of the plug and receptacle contact a portion of the conductive silicone 214 disposed in the receptacle to form an electrical connection. In various embodiments, the conductive silicone component 214 is made with alternating layers of conductive 215 and nonconductive 216 silicone as illustrated in FIG. 2C. When the connector of FIG. 2B is fully engaged, a pair of mated conductors contact at least one common layer of conductive material 215 in the conductive silicone component to complete the connection between the conductors. At least one insulating layer 216 exists between adjacent conductors such that electrical isolation between each conductor common to the plug or the receptacle is maintained.

Figure 2D:
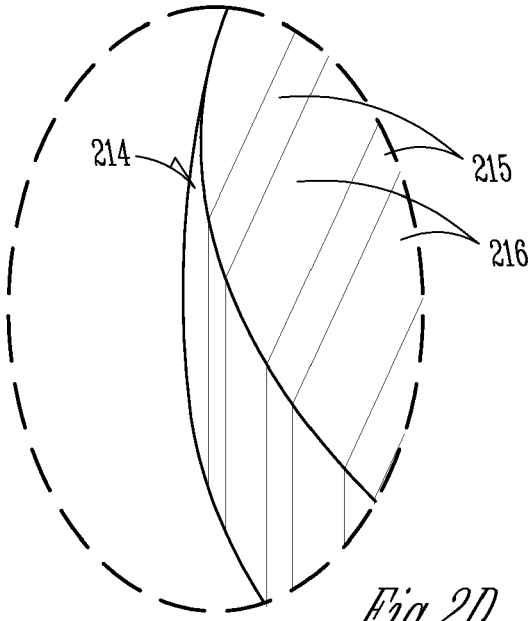

FIG. 2D is an enlarged view of a layer of one embodiment of a layer of conductive silicone 214 according to the present subject matter. The illustrated layer of conductive silicone 214 is made of alternating segments of conductive 215 and non-conductive material 216. One embodiment of a conductive silicone component 214 includes, for example, STAX™ elastomerics by Tyco Electronics. Other embodiments are possible without departing from the scope of the present subject matter.

Figure 3A:
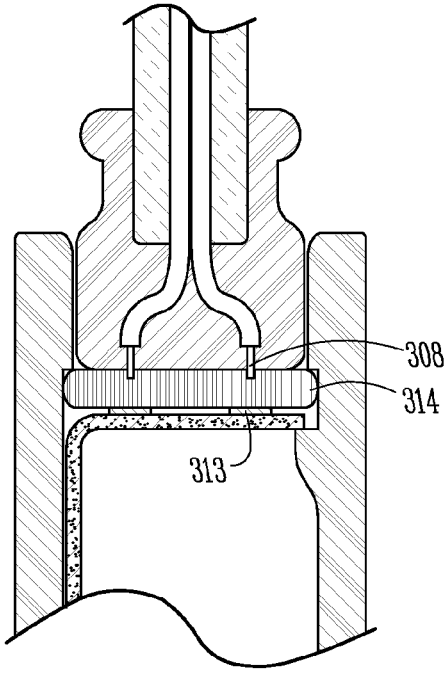
FIG. 3A illustrates a conductive silicone connector with exposed circuit board traces as receptacle conductors according to one embodiment of the current subject matter.
Figure 3B:
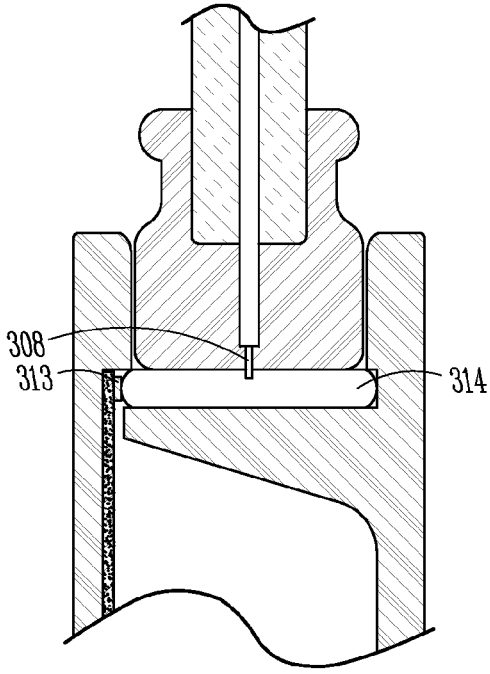
FIG. 3B illustrates one embodiment of a conductive silicone connector with exposed circuit board traces as receptacle conductors and the traces at a right angle to the insertion direction of the plug.

FIGS. 3A and 3B illustrate one example of a connector in which the receptacle includes exposed traces on a circuit board. FIG. 3A illustrates a straight through connector in which the face of the plug conductor 308 is parallel and opposite the face of the exposed circuit board trace 313 where contact is made with the conductive silicone component 314. FIG. 3B illustrates a 90 degree connector in which the face of the conductor 308 is at approximately 90 degrees to the face of the exposed circuit board trace 313 where contact is made with the conductive silicone component 314. Various embodiments include connections where the interface of the conductor and the exposed trace of the circuit board form additional angles. Various embodiments include connectors where the interface of the conductor and the exposed circuit board trace are offset. Conductive silicone components can be custom manufactured to allow a plurality of interface connection angles, orientations and offsets between mating portions of the connectors.

Figure 4:
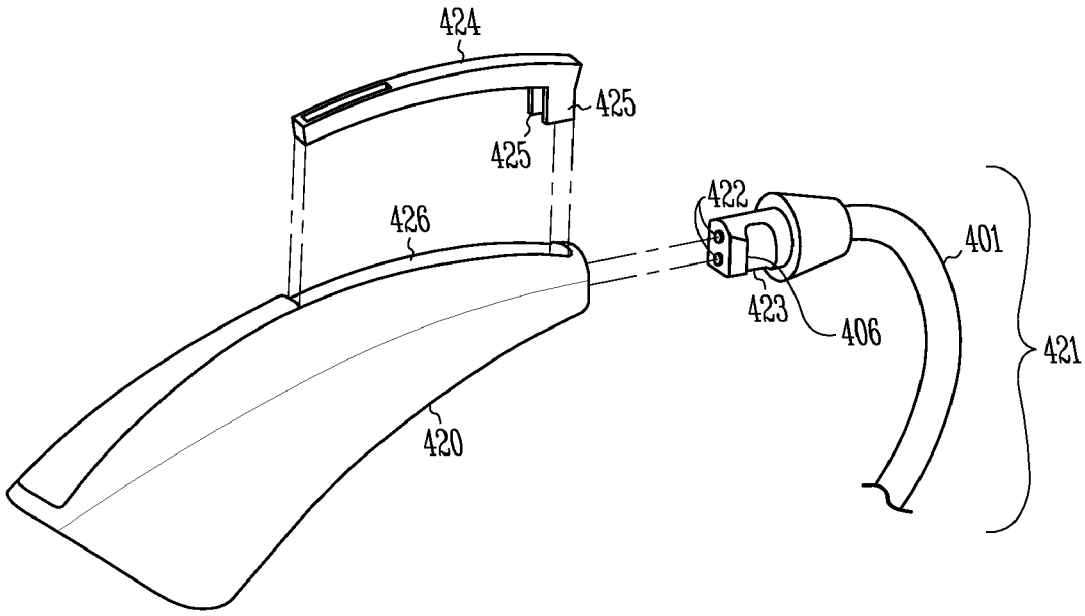
FIG. 4 illustrates one embodiment of a locking connector between a cable and a hearing assistance device housing.

FIG. 4 illustrates one embodiment of a connector for providing a reliable and maintained connection at a hearing assistance electronics housing 420. The conductor cable 421 includes a cable 401 and a plug 406. The plug 406 provides for mechanical connection to the housing 420 and electrical connection to enclosed electronics. The plug 406 presents the ends of the conductors 422 for contact with exposed traces of a flexible circuit board inside the receptacle of the housing 420. The electrical connection between the conductors of the cable 422 and the exposed traces of the housing use a conductive silicone component covering the exposed traces in the receptacle of the housing 420. The plug 406 is shaped to provide a snug fit when inserted into the receptacle of the housing 420 so as to protect the electrical connection points from the environment external to the receptacle. The illustrated plug 406 also includes a pair of grooves 423, one of which is visible in FIG. 4. The grooves 423 allow the plug 406 to be locked into place when the plug is engaged to the receptacle of the housing. The grooves 423, or the shape of the plug and receptacle, assist in orienting the plug such that the proper cable conductor engages the proper housing circuit board trace. The plug 406 is locked in place by a locking mechanism including a locking member 424. The illustrated locking member 424 includes two teeth 425 for engaging the grooves 423 of the plug 406 when the locking member 424 is snapped into an opening 426 of the housing 420. Because the locking member 424 is retained within the opening 426 of the housing, and the teeth 425 are engaged in the grooves 423 of the plug, the plug 406 is locked in both mechanical connection with the housing 420 and electrical connection with the enclosed electronics. In various embodiments, the illustrated connector is used with various hearing assistance device housings including, for example, behind-the-ear housings including housings worn over the ear and on the ear.

Figure 5:
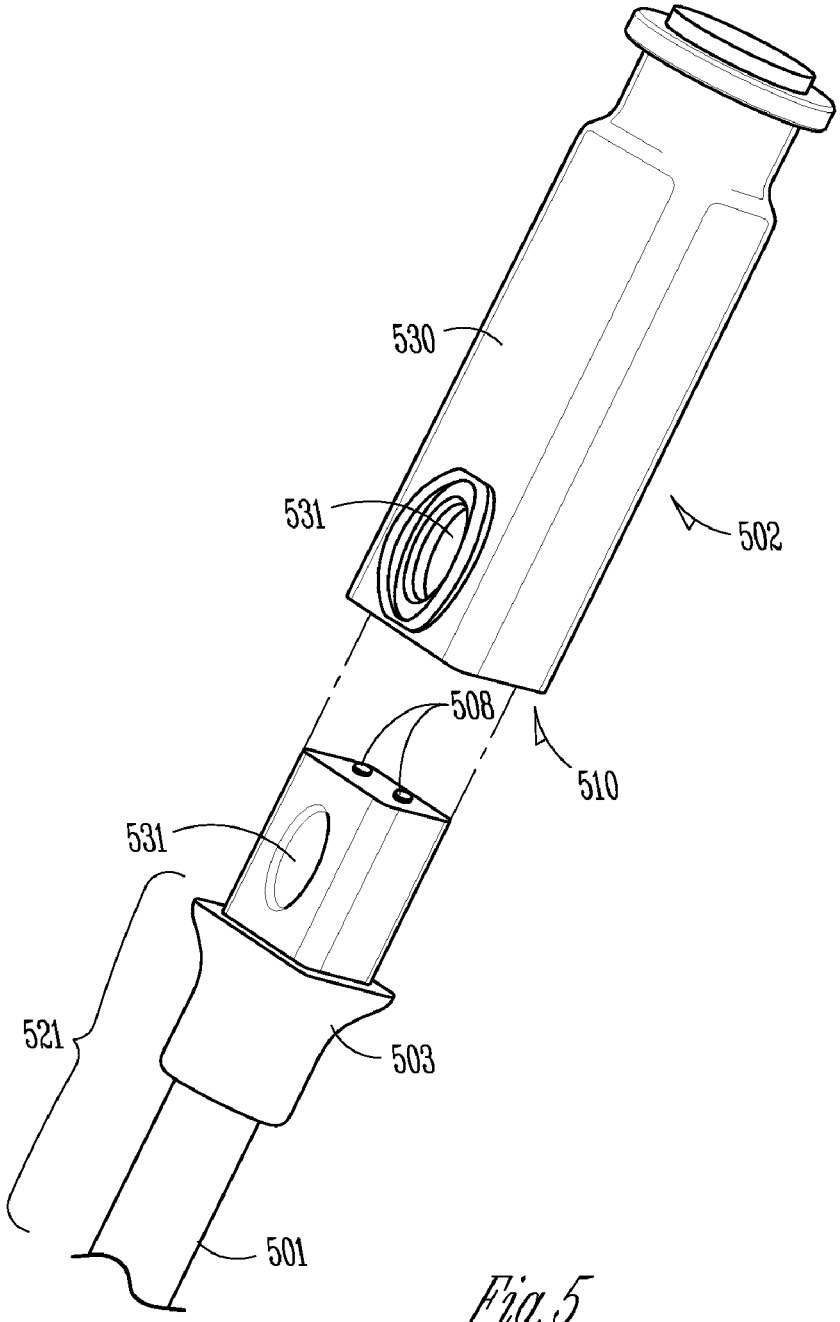
FIG. 5 illustrates one embodiment of a locking connector between a cable and a receiver according to the present subject matter.

FIG. 5 illustrates one embodiment of a connector according to the present subject matter for providing a reliable and maintained connection at a receiver 502. The conductor cable 521 includes a cable 501 and a plug 503. The plug 503 provides for mechanical connection to a receptacle 510 integrated into the housing 530 of the receiver 502. The plug 503 presents conductors 508 for electrical connection to the receiver 502 using a conductive silicone component disposed within the receptacle 510 of the receiver. Both the plug and the receiver housing receptacle 510 each have similarly shaped openings 531. The openings 531 align when the plug 503 is fully engaged in the receptacle 510 of the receiver.

Figure 6:
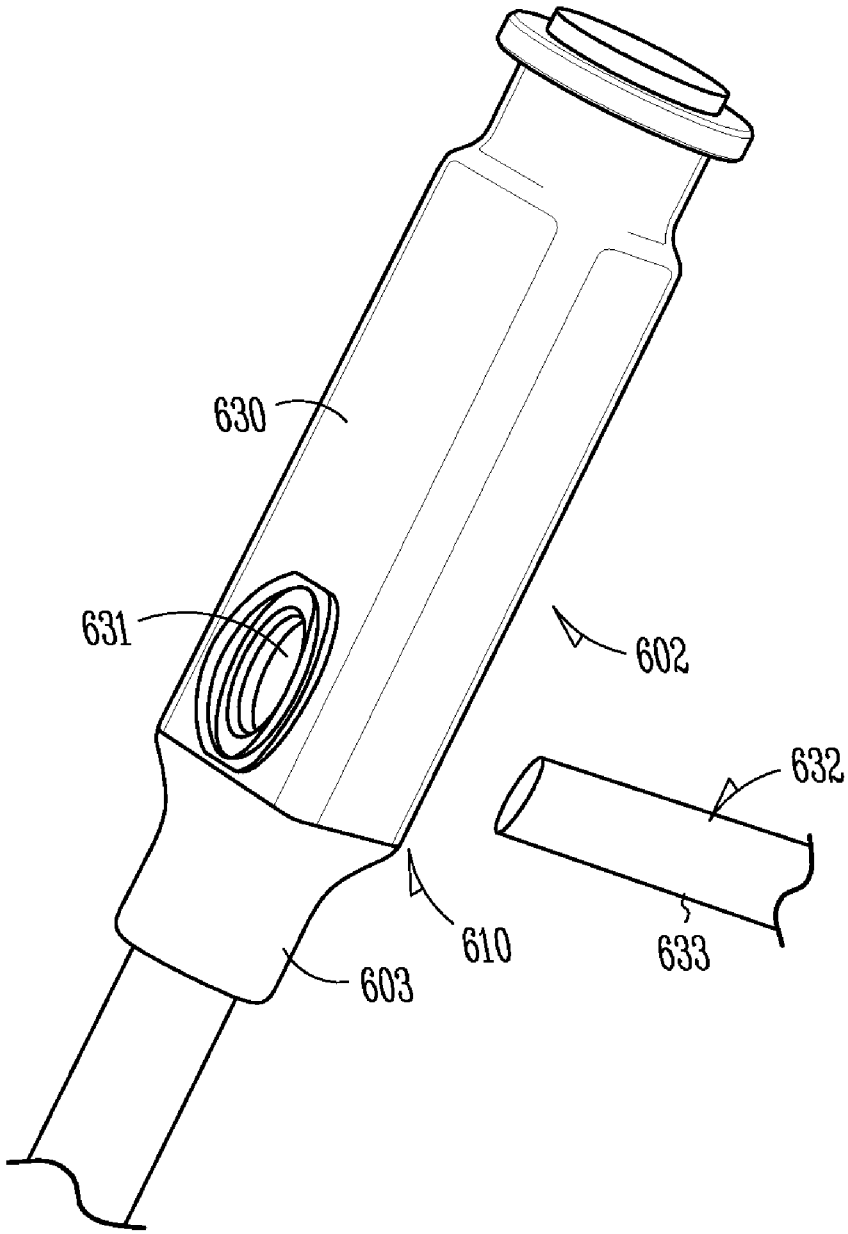
FIG. 6 illustrates one embodiment of a locking connector between a cable and a receiver according to the present subject matter.

A locking member 632, as shown in the embodiment of FIG. 6, is used to lock the connector in place. The locking member includes a head portion, not shown, and a tail 633. In various embodiments, the tail 633 has a cross section shape corresponding to the shape of the opening 631 formed by the mated plug 603 and receptacle 610 of the receiver housing 630. The tail 633 is tapered such that the smaller end of the tail passes through the aligned openings 631 with little resistance. As the length of the tail 633 is pulled through the opening 631, the locking member 632 eventually becomes snug within the opening 631 of the connector. The plug 603 and receptacle 610 connection is secure when the tail 633 is wedged in the opening 631. With the plug 603 locked in the receptacle 610 of the receiver 602, the exposed conductors of the plug 603 squeeze a layer of conductive silicone against the exposed conductors of the receiver electronics, thus forming an electrical connection. In various embodiments, the conductive silicone component provides an environmental seal of the connector.

Figure 7:
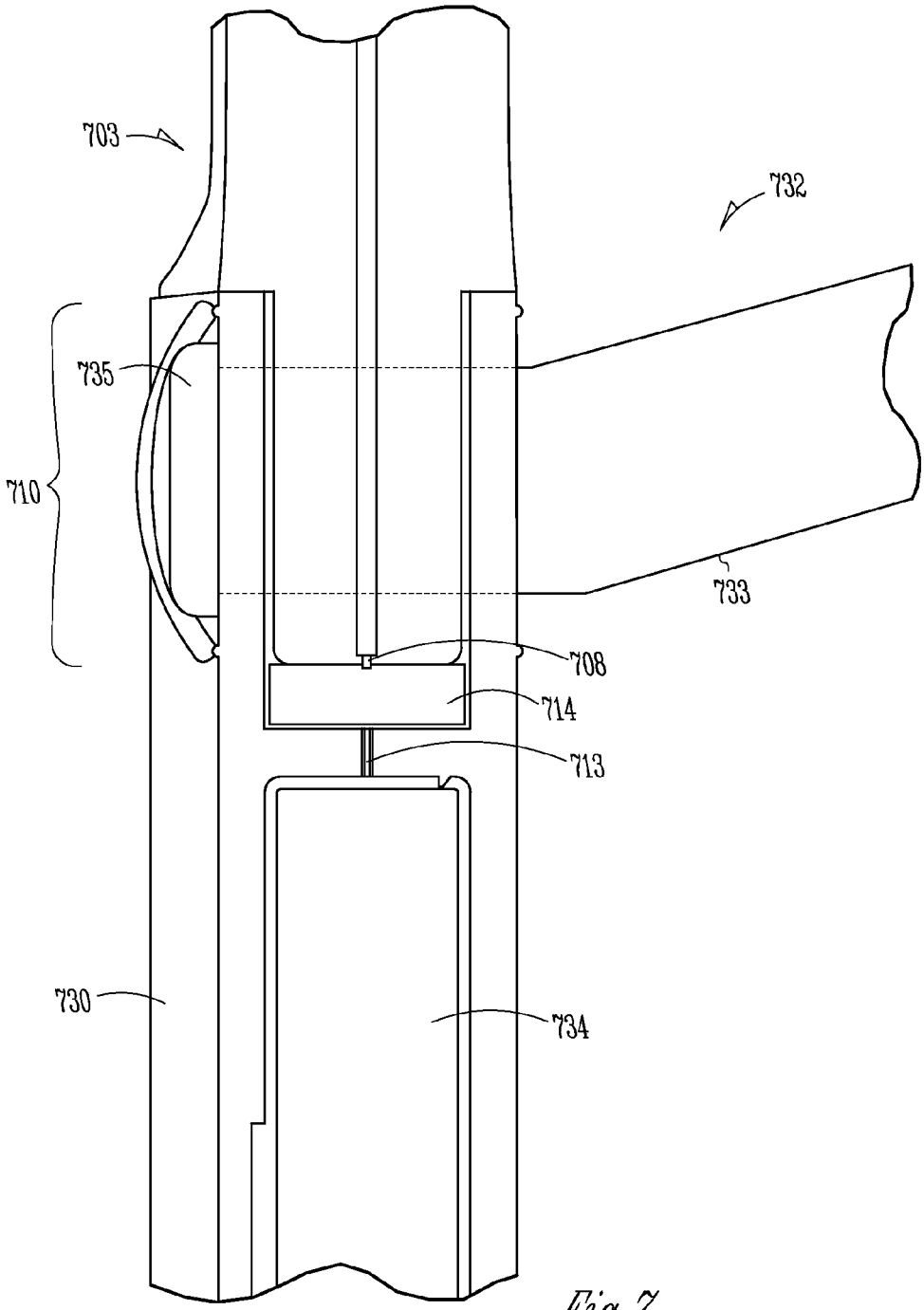
FIG. 7 illustrates a cross-section view of one embodiment of a locking connector between a cable and a receiver.

FIG. 7 illustrates a cross section of a mated connector according to one embodiment of the present subject matter. The illustration shows a plug 703, with an insulated conductor 708 engaged in a receptacle 710 with an exposed conductor 713 in contact with a layer of conductive silicone component 714 disposed in the well of receptacle 710. The exposed conductor 713 located in the well of the receptacle is connected to a receiver 734 disposed in a housing 730 that also forms the receptacle 710. The plug 703 is engaged in the receptacle 710 such that the exposed end of the plug conductor 708 is in contact with the conductive silicone component 714, thus forming an electrical connection with the exposed conductor of the receptacle 713. The plug 703 and receptacle 710 are locked in place by a locking member 732. The locking member includes a head 735 and a tail 733. The head 735 mechanically limits the passage of the tail 733 through the opening (FIG. 6, 631) formed by the openings of the mated plug 703 and receptacle 710. The tail 733, as explained above, is tapered such that the tail 733 wedges in the opening of the mated plug and receptacle as it is pulled through. When the locking member 732 is pulled to the extreme, as defined by the head 735, the locking member is securely in place to reliably retain the connection formed by the mated plug and receptacle. A user may desire to cut the portion of the tail 733 protruding from the opening, opposite the head 735, such that little or no tail remains protruding.

This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

What is claimed is:

1. A hearing assistance system for a user having an ear canal, the system comprising:

a housing;

electronics disposed in the housing;

a receiver adapted to be placed in the ear canal;

a cable electrically connected to the receiver; and at least one conductive silicone component including alternating layers of conductive and nonconductive silicone, wherein at least one layer of conductive silicone is adapted to electrically connect the electronics to the receiver.

2. The system of claim 1, wherein the receiver includes a receiver connector and wherein the cable comprises a first cable connector adapted to electrically connect with the receiver connector.

3. The system of claim 2, wherein the at least one conductive silicone component includes a layer of conductive silicone adapted to provide connection between at least one metal contact of the receiver connector and at least one metal contact of the first cable connector when the first cable connector and the receiver connector are mated.

4. The system of claim 2, wherein the at least one conductive silicone component includes a layer of conductive silicone adapted to provide a first connection and a first environmental seal to a plurality of contacts of the receiver connector and a plurality of contacts of the first cable connector.

5. The system of claim 2, wherein the receiver connector and the first cable connector are adapted to mechanically connect using a first locking mechanism.

6. The system of claim 5, wherein the first locking mechanism includes a locking member to retain the receiver in the ear canal, wherein the locking member includes;

a head; and a tail connected to the head.

7. The system of claim 6, wherein the tail includes a tapered portion.

8. The system of claim 7, wherein the receiver connector and the first cable connector each have an opening adapted to allow the tail to pass through the openings and mechanically fix the receiver connector to the first cable connector.

9. The system of claim 3, wherein the housing includes a housing connector and the cable includes a second cable connector adapted to electrically connect with the housing connector and wherein at least one conductive silicone component includes a layer of conductive silicone adapted to provide connection between at least one metal contact of the housing connector and at least one metal contact of the second cable connector when the second cable connector and the housing connector are mated.

10. The system of claim 4, wherein the housing includes a housing connector and the cable includes a second cable connector adapted to electrically connect with the housing connector and, wherein the at least one conductive silicone component includes a layer of conductive silicone adapted to provide a second connection and a second environmental seal to a plurality of contacts of the housing connector and a plurality of contacts of the second cable connector.

11. The system of claim 9, wherein the housing connector and the second cable connector are adapted to mechanically connect using a locking mechanism.

12. The system of claim 11, wherein the housing connector has an opening adapted to allow engagement of the locking mechanism with the second cable connector.

13. The system of claim 1, wherein the housing includes a housing connector and wherein the cable comprises a cable connector adapted to electrically connect with the housing connector.

14. The system of claim 13, wherein the at least one conductive silicone component includes a layer of conductive silicone adapted to provide a connection between at least one metal contact of the housing connector and at least one metal contact of the cable connector when the cable connector and the housing connector are mated.

15. The system of claim 13, wherein the at least one conductive silicone component includes a layer of conductive silicone adapted to provide a connection and an environmental seal to a plurality of contacts of the housing connector and a plurality of contacts of the cable connector.

16. The system of claim 14, wherein the housing connector and the cable connector are adapted to mechanically connect using a locking mechanism.

17. The system of claim 16, wherein the housing connector has an opening adapted to allow engagement of the locking mechanism with the cable connector.

18. The system of claim 1, further comprising an earbud mechanically connected to the receiver.

19. The system of claim 1, wherein the housing includes a behind-the-ear housing.

20. The system of claim 1, wherein the cable includes Electromagnetic Interference (EMI) shielding.

21. The system of claim 2, wherein the housing includes a housing connector;

wherein the cable includes a second cable connector adapted to electrically connect to the housing connector;

wherein the receiver connector includes a first receptacle and the first cable connector includes a first plug; and wherein the housing connector includes a second receptacle and the second cable connector includes a second plug.

22. A hearing assistance system connector comprising:

a first member having a first opening;

a second member having a second opening to receive the first member, the second member having a third and fourth opening forming a connector opening with the first opening of the first member when the first member is received in the second opening of the second member; and a locking member for retaining the first member in the second member, wherein the locking member is positioned within the connector opening;

at least one conductive silicone component including alternating layers of conductive and nonconductive silicone, wherein at least one layer of conductive silicone is adapted to electrically connect one or more conductors of the first member with one or more conductors of the second member.

23. The connector of claim 22, wherein at least one of the at least one conductive silicone components forms an environmental seal of the one or more conductors of the first member and the at least one or more conductors of the second member.

24. A hearing assistance system connector comprising:

a first member having one or more electrical conductors;

a second member having a first opening to receive the first member and a second opening adapted to provide access to the first member when received by second member;

a forked locking member adapted to engage at least one groove of the first member through the second opening of the second member to retain the first member within the first opening of the second member; and at least one conductive silicone component including alternating layers of conductive and nonconductive silicone, wherein at least one layer of conductive silicone is adapted to electrically connect the one or more electrical conductors of the first member to one or more electrical conductors of the second member.

25. The connector of claim 24, wherein at least one of the at least one conductive silicone components forms an environmental seal of the one or more conductors of the first member and the at least one or more conductors of the second member.

* * * * *

UNITED STATES PATENT AND TRADEMARK OFFICE

CERTIFICATE OF CORRECTION

PATENT NO. : 8,385,573 B2
APPLICATION NO. : 11/857439
DATED : February 26, 2013
INVENTOR(S) : Sidney A. Higgins It is certified that error appears in the above-identified patent and that said Letters Patent is hereby corrected as shown below:

On the title page

Item (56) in column 1, under "Other Publications", line 2, delete "Mailed" and insert --mailed--, therefor On page 2, Item (56) in column 1, under "Other Publications", line 4, delete "Mailed" and insert --mailed--, therefor On page 2, Item (56) in column 1, under "Other Publications", line 13, delete "Filed" and insert --filed--, therefor On page 2, Item (56) in column 2, under "Other Publications", line 2, delete "Filed:" and insert --filed--, therefor On page 2, Item (56) in column 2, under "Other Publications", line 10, delete "L S," and insert --L. S.,--, therefor Signed and Sealed this
Fourth Day of November, 2014

Michelle K. Lee

Michelle K. Lee
*Deputy Director of the United States Patent and Trademark Office*